US007601051B2

(12) United States Patent
Tanaka

(10) Patent No.: US 7,601,051 B2
(45) Date of Patent: Oct. 13, 2009

(54) GRINDING MACHINE HAVING GRINDER HEAD AND METHOD OF MANUFACTURING SEMICONDUCTOR DEVICE BY USING THE GRINDING MACHINE

(75) Inventor: Yasuo Tanaka, Tokyo (JP)

(73) Assignee: Oki Semiconductor Co., Ltd, Tokyo (JP)

( * ) Notice: Subject to any disclaimer, the term of this patent is extended or adjusted under 35 U.S.C. 154(b) by 0 days.

(21) Appl. No.: 11/905,743

(22) Filed: Oct. 3, 2007

(65) Prior Publication Data

US 2008/0139090 A1 Jun. 12, 2008

(30) Foreign Application Priority Data

Dec. 12, 2006 (JP) ..... 2006-334620

(51) Int. Cl.
*B24B 1/00* (2006.01)

(52) U.S. Cl. ..... 451/41; 451/63; 451/285; 451/289; 451/548

(58) Field of Classification Search ..... 451/29, 451/41, 54, 63, 69, 285, 287, 289, 548, 56, 451/443

See application file for complete search history.

(56) References Cited

U.S. PATENT DOCUMENTS

| | | | | |
|---|---|---|---|---|
| 4,663,890 | A * | 5/1987 | Brandt | 451/41 |
| 6,949,012 | B2 * | 9/2005 | Barnett, III | 451/56 |
| 2003/0003858 | A1 * | 1/2003 | Hirata et al. | 451/541 |
| 2005/0118938 | A1 * | 6/2005 | Mizomoto et al. | 451/65 |
| 2005/0215188 | A1 * | 9/2005 | Toge et al. | 451/444 |
| 2006/0079155 | A1 * | 4/2006 | Nakamura et al. | 451/41 |
| 2007/0004180 | A1 * | 1/2007 | Abe | 438/460 |

FOREIGN PATENT DOCUMENTS

| | | |
|---|---|---|
| JP | 2000-301645 A | 10/2002 |
| JP | 2004-276197 | 10/2004 |

* cited by examiner

*Primary Examiner*—Eileen P. Morgan
(74) *Attorney, Agent, or Firm*—Rabin & Berdo, P.C.

(57) ABSTRACT

A grinding machine for grinding a workpiece, including a chucking table having a chucking area and a grinder head. The grinder head includes a spinning disk rotating about a rotation axis and a plurality of grindstones, which are circularly arranged on a surface of the spinning disk, whereby a slit is created between the adjacent grindstones, wherein both of the adjacent grindstones is arranged to make contact with an edge of the workpiece while grinding the workpiece.

13 Claims, 7 Drawing Sheets

GRINDING MACHINE HAVING GRINDER HEAD AND METHOD OF MANUFACTURING SEMICONDUCTOR DEVICE BY USING THE GRINDING MACHINE

CROSS-REFERENCE TO RELATED APPLICATION

This application claims the priority benefit of Japanese Patent Application No. 2006-334620, filed Dec. 12, 2006, the entire disclosure of which is incorporated herein by reference.

BACKGROUND OF THE INVENTION

1. Field of the Invention

The invention relates to a grinding machine having a grinder head and a method of manufacturing a semiconductor device by using the grinding machine, and specifically, relates to a grinder head for grinding a back surface of a semiconductor wafer on which semiconductor elements are formed and a grinding machine having the grinder head.

2. Description of the Related Art

In recent years, with the progress of miniaturization of electric devices, semiconductor chips, which are mounted thereon, are also miniaturized. Specifically, it is required that the thickness of a semiconductor chip should also get thinner. For example, the size of a passive device, such as a condenser being mounted on a mounting board, is changed from 1005 to 0603, and then to 0402. For this reason, an active device (such as a semiconductor device having transistors), which is mounted together with the passive device, is also desired to be miniaturized to the same degree as the passive device.

One of the methods to make a semiconductor device thin is to grind a back surface of a semiconductor wafer, as shown in Japanese patent publication 2002-301645. A general grinding machine used in this field includes a chunking table having a plurality of minute openings and a grinder head having a plurality of grindstones, which are aligned along the periphery of the grinder head. A semiconductor wafer to be ground (hereinafter called "the workpiece") is mounted on the chunking table in the condition that the back surface of the workpiece is exposed. Then, the grindstones on the spinning grinder head contact the back surface of the workpiece, and the workpiece is ground from its back surface.

As shown in FIG. 7 of the cited Japanese patent publication 2002-301645, there are some slits created between the grindstones for the purpose of discharging a coolant (ex. pure water). For this reason, while grinding, there are two conditions at the periphery of the workpiece; that is, the first condition is that the workpiece contacts the grindstones, and the second condition is that the workpiece does not contact the grindstones. In other words, in the first condition, the workpiece is held down by the grindstones, and in the second condition, the workpiece is not held down by them. These conditions occur alternately.

When the workpiece is manufactured by a process of WCSP (Wafer-level Chip Size Package), a step difference is created on the workpiece at the periphery because a resin for sealing the semiconductor device is not formed there. Since the step difference is generally around 100 μm height, it is difficult to eliminate the step difference by a grind tape. Thus, when the workpiece manufactured by the WCSP process is affixed by the grind tape on the chunking table, a gap is formed between the workpiece and the chunking table. This means that the entire surface of the workpiece is not chucked, and the workpiece at its periphery is in a condition of floating from the chucking table.

Under this condition, when the grindstones pass on the periphery of the workpiece intermittently, vibration may occur on the workpiece at its periphery. For this reason, when the workpiece is ground from its periphery to its center, large numbers of linear scratches having a 100 μm depth are formed at the periphery of the workpiece, or the workpiece is sometimes cracked at its periphery. In the contrary case that the workpiece is ground from its center to its periphery, the workpiece at the periphery is ground more than that at other areas. As a result, the stiffness property of the workpiece at the periphery is weakened so that the workpiece is cracked or divided at its periphery in later processing.

Further, if the workpiece, which is manufactured without any step deference on its surface, is ground, the periphery of the workpiece placed on the chucking table does not float. However, the chucking area of the chucking table is generally smaller than the workpiece in the grinding machine of the related art. Thus, even if the workpiece has no step difference, the periphery of the workpiece is not affixed to the chucking table. Thus, in a case that the workpiece is ground to be relatively thin, such as less than 100 μm, the stiffness of workpiece itself is weakened so that the periphery of the workpiece vibrates more intensely. As a result, as well as the workpiece having a step difference, large numbers of linear scratches are formed at the periphery of the workpiece, or the workpiece is cracked at its periphery. Further, the workpiece is ground more at its periphery than at other areas.

SUMMARY OF THE INVENTION

An objective of the invention is to solve the above-described problem and to provide a grinding machine having a grinder head that does not cause the workpiece to vibrate at its periphery. A further objective is to provide a method of manufacturing a semiconductor device by which fewer linear scratches and cracks are formed on the workpiece by using a grinding machine having the grinder head.

The objective is achieved by a grinding machine for grinding a workpiece, including a chucking table having a chucking area and a grinder head wherein the grinder head includes a spinning disk rotating about a rotation axis and a plurality of grindstones, which are circularly arranged on a surface of the spinning disk, whereby a slit is created between the adjacent grindstones, wherein both of the adjacent grindstones are arranged to make contact with an edge of the workpiece while grinding the workpiece.

The further objective is achieved by a method of manufacturing the semiconductor device, the method includes a step of preparing a workpiece including a semiconductor wafer having a main surface on which semiconductor elements are formed, a protective layer formed on the main surface, and electrodes formed on the protective layer, a step of putting a grind tape on an entire surface of the workpiece on which the electrodes are formed, a step of preparing a grinding machine having a chucking table having a chucking area and a grinder head wherein the grinder head includes a spinning disk rotating about a rotation axis and a plurality of grindstones, which are circularly arranged on a surface of the spinning disk, whereby a slit is created between the adjacent grindstones, wherein both of the adjacent grindstones are arranged to make contact with an edge of the workpiece while grinding the workpiece, a step of affixing the workpiece in the chucking area of the chucking table, whereby the back surface of the workpiece is exposed, a step of grinding the workpiece from its back surface by the grinder head, and a step of dividing the ground workpiece into a plurality of individual devices.

BRIEF DESCRIPTION OF THE DRAWINGS

The invention will be more particularly described with reference to the accompanying drawings, in which.

DETAILED DESCRIPTION OF THE PREFERRED EMBODIMENTS

The preferred embodiment of the invention is explained together with drawings as follows. In each drawing, the same reference numbers designate the same or similar components.

Fundamental Embodiment

Initially, the fundamental embodiment of the invention is explained with reference to some drawings as follows. In the fundamental embodiment, a workpiece including a semiconductor wafer, a protective resin layer and electrodes, which is manufactured by a WCSP (Wafer-level Chip Size Package) process, is used as a representative example, and such a workpiece is ground by a grinding machine 1. However, the invention is not limited to processing such a workpiece; any workpiece that is intended to be ground to have its thickness, which is less than 100 μm for instance, can be used for this invention.

Figure 1A:
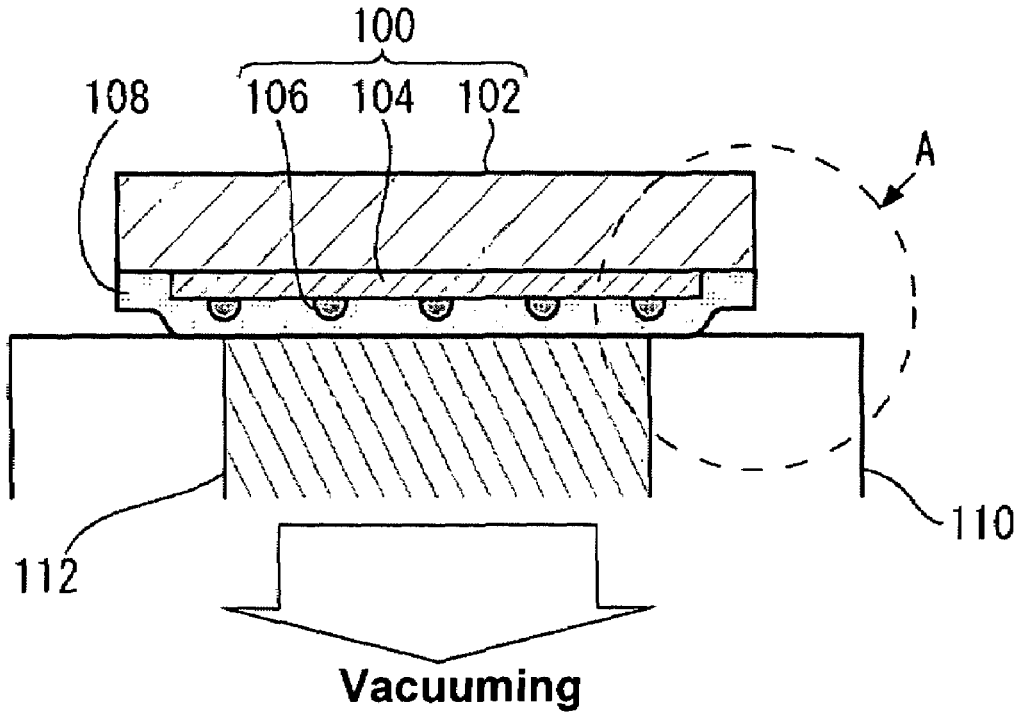
FIG. 1A is a sectional view showing a skeleton framework of a workpiece used in the fundamental embodiment, and a chucking table on which the workpiece is mounted.
Figure 1B:
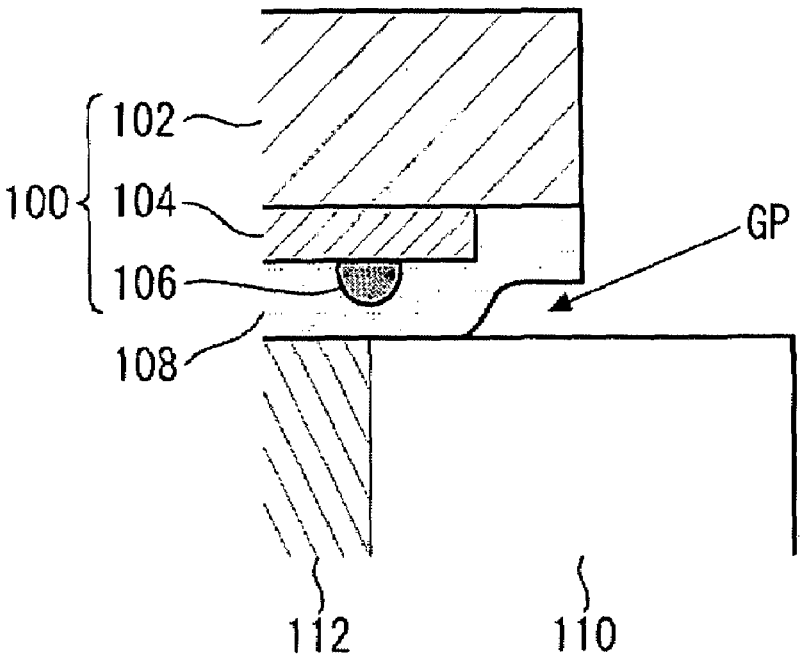
FIG. 1B is an enlarged view of an area A shown in FIG. 1A.

FIG. 1A is a sectional view showing a skeleton framework of a workpiece 100 used in the fundamental embodiment and a chucking table 110 on which the workpiece 100 is mounted. FIG. 1B is an enlarged view of an area "A" shown in FIG. 1A. In these drawings, the workpiece 100 is mounted on the chucking table 120 face down. Being "face down" means that one surface of the semiconductor wafer on which active elements are formed (generally called "a main surface") faces the chucking table 120, and the opposite surface, which is called "a back surface", is exposed.

As shown in FIG. 1A, the workpiece 100 includes a semiconductor wafer 102, a protective resin layer 104, and electrodes 106. The protective resin layer 104 covers the main surface of the semiconductor wafer 102 in an area where many active parts are formed. As shown, the protective resin layer 104 is not formed on the entire surface. In other words, the protective resin layer 104 is not formed at the periphery of the semiconductor wafer 102. For this reason, a step difference is formed between the semiconductor wafer 102 and the protective resin layer 104 at the periphery of the workpiece 100. Some electric posts, each of which is connected at one end to one of circuit wirings formed on the main surface of the semiconductor wafer 102, are formed in the protective resin layer 104, and they are exposed at the opposite ends on the protective resin layer 104. Each electrode 106, such as a hemispherical-shaped solder ball electrode, is formed on one of the exposed electric posts.

As shown in FIG. 1A, a grind tape 108 having an adhesive layer is put on the entire main surface of the workpiece 100 on which the electrodes 106 are formed, in order to eliminate the unevenness caused by the electrodes 106. This is made to eliminate the unevenness formed on the surface, which is mounted on the chucking table 110. However, the step difference formed at the periphery of the workpiece 100 is bigger than that formed on the protective layer 104, which can be eliminated by the grind tape 108. For this reason, the step difference formed there cannot be eliminated by the grind tape 108, while the uneven surface made by the electrodes 160 is eliminated by the grind tape 108. Thus, as shown in FIG. 1B, when the workpiece 100 on which the grind tape 108 is put is mounted on the chucking table 110 face down, a gap GP is still created between the chucking table 110 and the workpiece 100 at its periphery.

Figure 2:
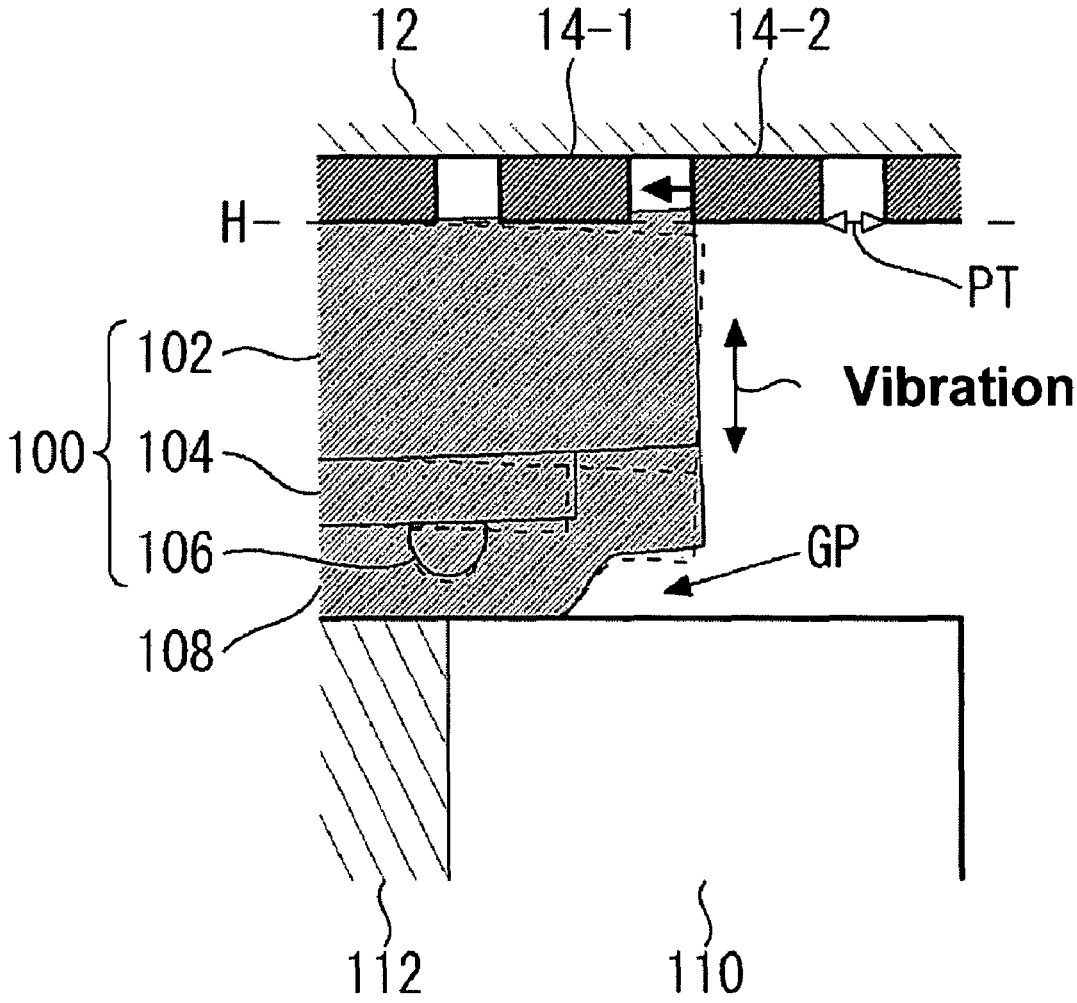
FIG. 2 is a sectional view explaining vibration that occurs at the periphery of the workpiece when the workpiece is ground from its periphery to its center, according to the related art.

As shown in FIG. 2 and described above in the Background of the Invention, under the condition that there is a gap GP between the chucking table 110 and the workpiece 100, namely, under the condition that the workpiece 100 is floating at its periphery, the edge (periphery) of the workpiece 100 is vibrated when the back surface of the semiconductor wafer 102 is ground from its edge to its center because there are two conditions at the periphery of the workpiece 100; the first condition is that the workpiece 100 contacts grindstones 14-1, 14-2, and the second condition is that the workpiece 100 does not contact the grindstones 14-1, 14-2, and these conditions occur alternately. For this reason, large numbers of linear scratches are formed at the periphery of the workpiece 100 or the workpiece 100 is cracked at its periphery. Further, as described above in the Background of the Invention, in the case that the workpiece 100 is ground from its center to its periphery, the two conditions described above alternately may also occur, causing the workpiece 100 to vibrate. As a result, the workpiece 100 at the periphery is ground more than that at the other area, and the stiffness of workpiece 100 at the periphery is weakened.

The thinner the workpiece 100 is ground, the larger will be vibration at the periphery of the workpiece 100. For this reason, when the workpiece 100 is manufactured by the WCSP technique, it is difficult to grind the semiconductor wafer 102 of the workpiece 100 having thickness less than a 300 μm.

So, according to the fundamental embodiment, while there are some slits created between the grindstones for the purpose of discharging a coolant (ex. pure water), the grindstones always contact the edge of the workpiece 100, whereby it is possible to reduce vibration at the peripheral of the workpiece 100. As described above, there are two ways to grind the workpiece 100; one is to grind from the edge to the center, another is to grind from the center to the edge. For the sake of brevity, only the first way is explained in detail.

Figure 3A:
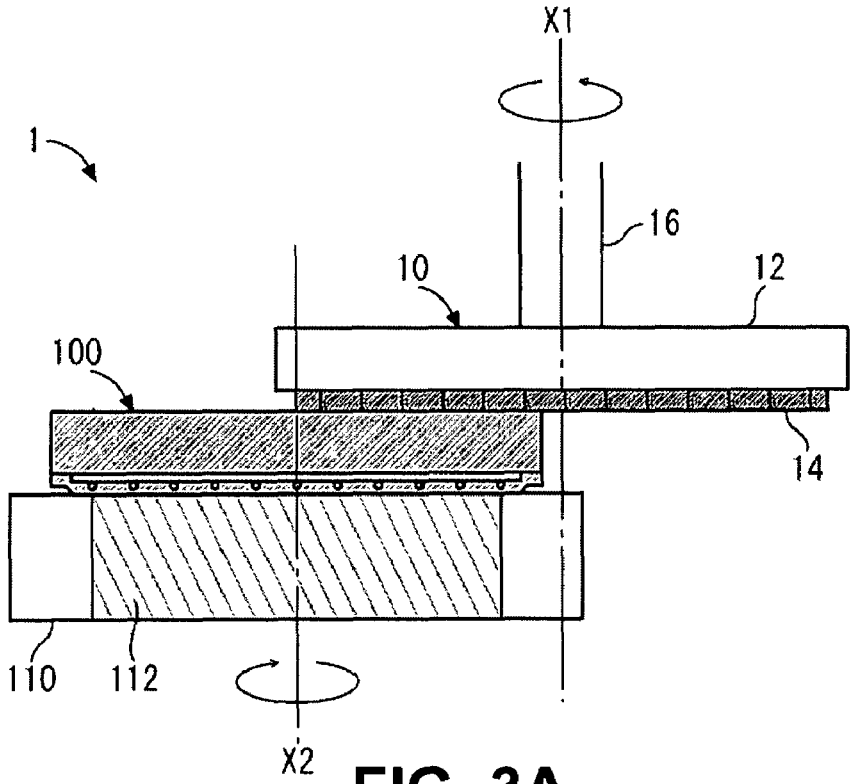
FIG. 3A is a sectional view showing a skeleton framework of a grinding machine, according to a fundamental embodiment of the invention.
Figure 3B:
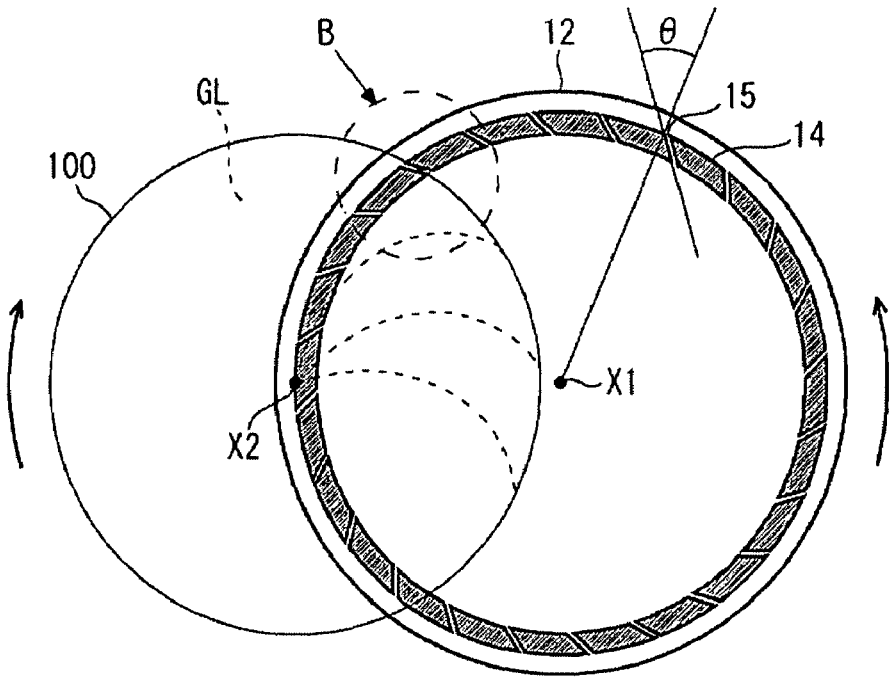
FIG. 3B is a plan view showing a relationship between the grinder head used in FIG. 3A and the workpiece.
Figure 4A:
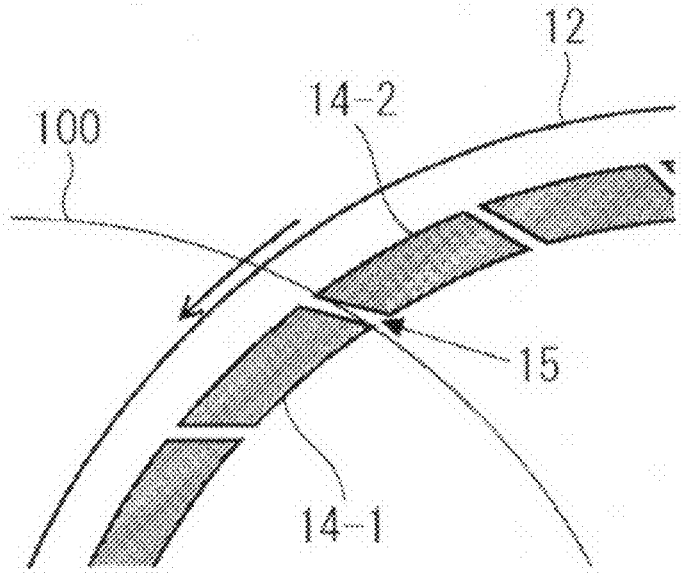
FIG. 4A is an enlarged view of an area B shown in FIG. 3B.

FIG. 3A is a sectional view showing a skeleton framework of a grinding machine 1, and FIG. 3B is a plan view showing a relationship between a grinder head 10 used in FIG. 3A and the workpiece 100. FIG. 4A is an enlarged view of an area B shown in FIG. 3B. As shown in FIG. 3A, the grinding machine 1 includes a rotatable grinder head 10 and a rotatable chucking table 110. The workpiece 100 having the grind tape 108 is mounted on the rotatable chucking table 110.

The grinder head includes a drive shaft 16 having a rotation axis x1, a spinning disk 12 rotating about the rotation axis x1 and a plurality of grindstones 14, which are circularly arranged on a bottom surface of the spinning disk 12. As to the alignment of the grindstones 14, at least both of two adjacent grindstones 14-1, 14-2 as shown in FIG. 4A are aligned to contact the edge of the workpiece 100 while grinding it.

The chucking table 110 can rotate about the rotation axis x2. The chucking table 110 includes a chucking area 112 in which a plurality of vacuum holes are formed. The workpiece 100 mounted on the chucking table 110 at the chucking area 112 is chucked on the chucking table 110 through the holes using suction while grinding.

In the process of grinding the workpiece 100 with the grinding machine having the structure described above, a coolant such as pure water, is provided onto the workpiece's back surface that is to be ground, while the chucking disk 110 rotates at a few hundred revolutions per minute in one direction, and the grinder head 10 rotates at a few thousand revolutions per minute in the opposite direction. The semiconductor wafer 102 of the workpiece 100 is ground from its back surface by this process.

Now, the arrangement of the grindstones 14 is further explained in detail. As explained above with reference to FIG. 3B, the grindstones 14 are circularly arranged along the outer circumference on the bottom surface of the spinning disk 12. In the fundamental embodiment, twenty four (24) grindstones 14 are circularly arranged. However, the scope of the invention is not limited to a particular number of grindstones. For example, it is possible to modify the number of the grindstones 14 to twenty seven (27) or fifty four (54) in accordance with the purposes depending on.

Each grindstone 14 is a quadrangular-shaped prism whose surface that may contact the workpiece 100, is almost parallelogram-shaped. A slit 15, which is taken about the rotating direction, is created between the adjacent grindstones 14. As shown in FIG. 3B, the slit 15 is angled at an angle θ in the direction of rotation of the spinning disk 12 from the line passing through the rotation axis x1. To the contrary, the slit 15 may be angled at the angle θ in the opposite direction from the line passing through the rotation axis x1, as another alternative. However, it is better that the slits 15 be angled in the direction of the rotation because the grinding sludge and the coolant easily can be discharged from the ground surface of the workpiece 100 through the slits 15.

Further, according to the fundamental embodiment, as shown in FIG. 4A, two adjacent grindstones 14-1, 14-2 are aligned to contact the edge of the workpiece 100 to be ground while grinding the workpiece 100. In other words, in order to contact two adjacent grindstones 14-1, 14-2 with the edge of the workpiece 100 while grinding, the angle θ, a width of the slit 15 (a distance between two adjacent grindstones 14-1, 14-2), the length of the grindstone, which is taken about to the line passing through the rotation axis x1 (hereinafter called "the width", and referred as "d" in FIGS. 5B and 5C) are determined.

Figure 4B:
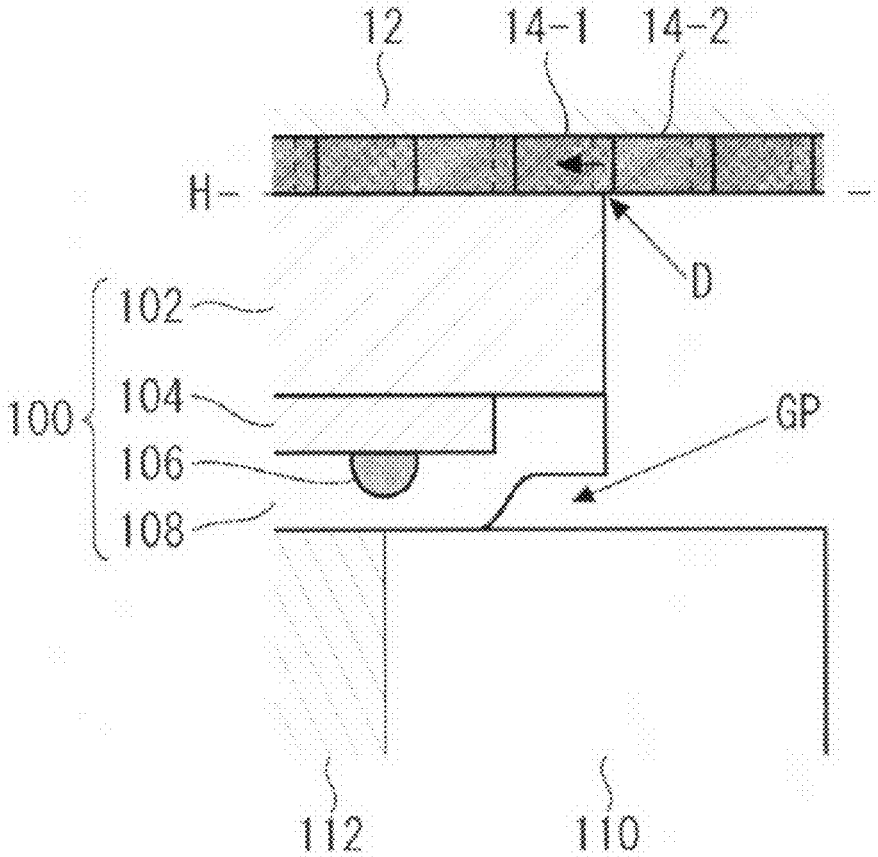
FIG. 4B is an enlarged sectional view explaining the condition that grindstones pass continuously on the periphery of the workpiece, according to the grinding process of the fundamental embodiment.

As a result of this configuration, the grindstones 14 continuously make contact with the workpiece 100 at its periphery as shown in FIG. 4B. As a result, since the edge of the workpiece 100 is pressed against the chucking table 110 by the grindstone 14 continuously, the occurrence of vibration at the periphery of the workpiece 100 can be suppressed. As a result, it is possible to reduce the number of deep linear scratches (hereinafter called "the grinding mark") formed on the back surface of the workpiece 100 or cracks.

According to the fundamental embodiment, the angle θ is set between 30 degrees and 60 degrees, and the width of the slit 15 is set between 1.0 mm and 2.5 mm. The width d of the grindstone is set around 4 mm. According to the inventor's research, when the angle θ is set between 30 degrees and 60 degrees, it was found that the number of cracks or deep linear scratches (hereinafter called "the grinding mark") formed on the back surface of the workpiece 100 are reduced. For example, when the angle θ, the width of the slit 15 and the width d of the grindstone are set at 45 degrees, 1.5 mm and 4 mm, respectively, the number of deep linear scratches or cracks are not only reduced, but the depth of the grinding mark can also be controlled to be less than 5 μm.

Figure 5A:
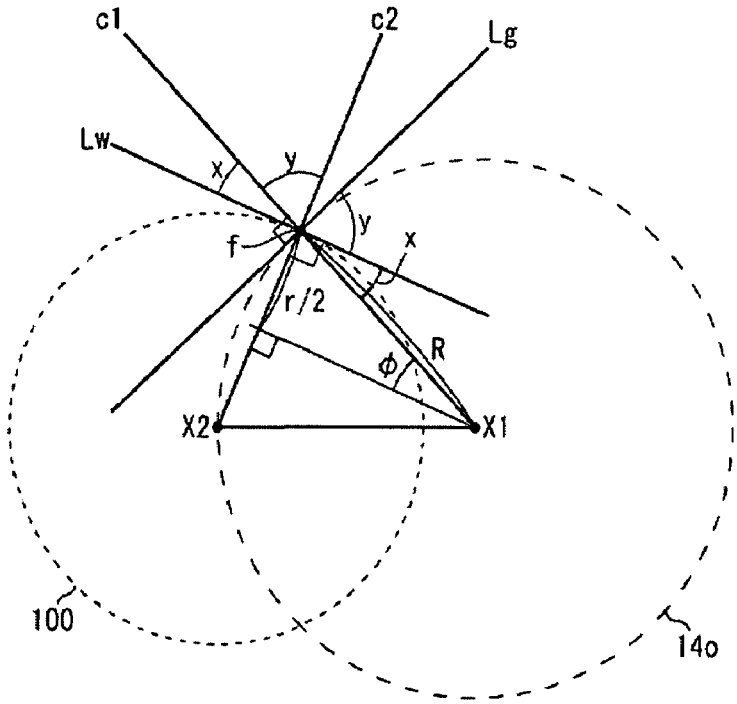
FIGS. 5A through 5C are diagrams explaining a conditional equation in which angles x and θ satisfy, according to the fundamental embodiment.
Figure 5B:
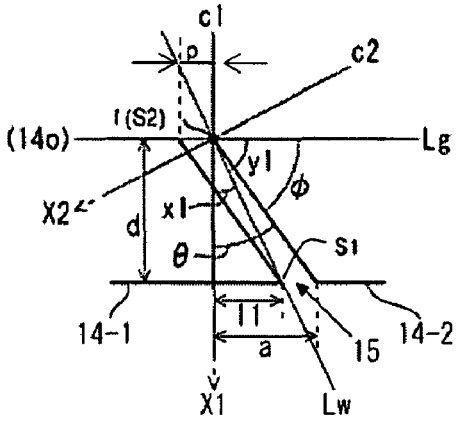

According to the fundamental embodiment, the length of each of twenty-four grindstones 14 is set at 28.125 mm. Thus, if twenty-seven grindstones 14 are circularly arranged, the length of each grindstone is set at 25 mm, and if fifty-four grindstones 14 are circularly arranged, the length of each grindstone is set at 12.5 mm As described above, although it is preferred that the angle θ be set between 30 degrees and 60 degrees, the scope of the invention is not limited to these dimensions, and, the dimensions can be modified to comply with the following descriptions. For example, the angle θ can be set by satisfying a conditional equation 8 or 9 described below. FIG. 5A through 5B are diagrams explaining the conditional equation in which angles x and θ satisfy. In these drawings, "f" represents the point where a locus 14*o* (hereinafter called as "the grindstone outer locus"), which is drawn by the outer edge of the grindstone 14, and the edge of the workpiece 100 are contacted. "Lg" is the tangential line of the grindstone outer locus 14*o* at the point f. "Lw" is the tangential line of the edge of the workpiece 100 at the point f. "c1" is the straight line connecting the point f to the rotation axis x1, and "c2" is the straight line connecting the point f to the rotation axis x2. "R" represents the distance between the rotation axis x1 and the grindstone outer locus 14*o* (namely, a radius of the grindstone outer locus 14*o*), and "r" represents the distance between the rotation axis x2 and the edge of the workpiece 100 (namely, a radius of the workpiece 100). As explained, "d" is the width of the grindstone, and "p" represents the width of the slit 15. "a" represents the length of a base of a triangle, which is formed by the rear hypotenuse of the grindstone 14-1 or the front hypotenuse of the grindstone 14-2, the straight line, such as a line c1, which passes at the rotation axis x1 and a grindstone inner locus. In this instance, the bottom of this triangle means the line of the grindstone inner locus. "l1" represents the length of a base of a triangle, which is formed by the straight line c1, the tangential line Lw and the grindstone inner locus. In this instance, the bottom of this triangle also means the line of the grindstone inner locus. "φ" represents the angle formed by the tangential line Lg and the slit 15 (90 degrees−θ). "x" represents the angle formed by the tangential line Lw and the straight line c1 at the point f, and "y" represents the angle formed by the tangential lines Lw and Lg (90 degrees−x).

Further, when the tangential line Lw is set to pass on a rear-vertex s1 of the inner side of the grindstone 14-1 and a front-vertex s2 of the outer side of the grindstone 14-2 (that is the point f), "x1" represents the angle formed by the tangential line Lw and the straight line c1, and "y1" represents the angle formed by the tangential lines Lw and Lg. On the other hand, when the tangential line Lw is set to pass on a rear-vertex s3 of the outer side of the grindstone 14-1 (that is the point f) and a front-vertex s4 of the outer side of the grindstone 14-2, "x2" represents the angle formed by the tangential line Lw and the straight line c1, and "y2" represents the angle formed by the tangential lines Lw and Lg.

It is clear from FIGS. 5A and 5B that the distance a and the length l1 can be determined in the following equations (1).

$$a=d\times\tan\theta$$

$$l1=a-p=d\times\tan x1 \quad (1)$$

Accordingly, when length l1 is replaced by the width d and the angle x1, the following equation (2) can be obtained.

$$l1=a-p=d\times\tan\theta-p=d\times\tan x1 \quad (2)$$

As shown in the following equation (3), the angle x1 can be obtained from the equation (2).

$$x1=\tan^{-1}\left(\frac{d\times\tan\theta-p}{d}\right) \quad (3)$$

Moreover, it is also clear from FIGS. 5A and 5C, the distance a and the length l2 can be shown in the following equation (4).

$$a=d\times\tan\theta$$

$$l2=a+p=d\times\tan x2 \quad (4)$$

Accordingly, when length l2 is replaced by the width d and the angle x2, the following equation (5) can be obtained.

$$l2=a+p=d\times\tan\theta+p=d\times\tan x2 \quad (5)$$

As shown in the following equation (6), the angle x2 can be obtained from the equation (5).

$$x2=\tan^{-1}\left(\frac{d\times\tan\theta+p}{d}\right) \quad (6)$$

Figure 5C:
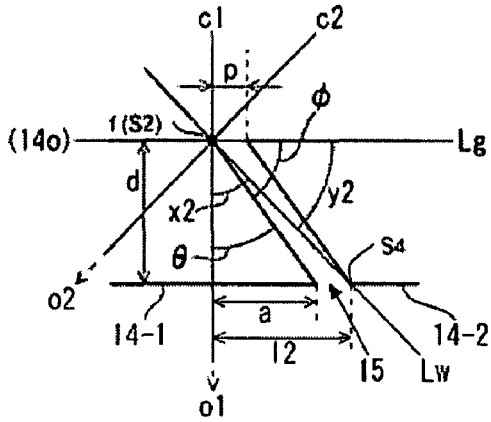

It is clear from FIGS. 5A through 5C, and the equations (3)-(6), if the angle x is set within the following equation (7), the adjacent grindstones 14-1 and 14-2 do not contact the workpiece 100 to be ground at its periphery continuously.

$$\tan^{-1}\left(\frac{d\times\tan\theta-p}{d}\right)<x<\tan^{-1}\left(\frac{d\times\tan\theta+p}{d}\right) \quad (7)$$

Thus, the equation (7) requires the angle θ, the width d of the grindstone 14 and the width p of the slit 15 to be set to cause the angle x to satisfy the following compression (8).

$$x\le\tan^{-1}\left(\frac{d\times\tan\theta-p}{d}\right),\ \tan^{-1}\left(\frac{d\times\tan\theta+p}{d}\right)\le x \quad (8)$$

In other words, the equation (7) may require the angle x, the width d of the grindstone 14 and the width p of the slit 15 to be set to cause the angle θ to satisfy the following compression (9).

$$\theta\le\tan^{-1}\left(\frac{d\times\tan x+p}{d}\right),\ \tan^{-1}\left(\frac{d\times\tan x-p}{d}\right)\le\theta \quad (9)$$

According to the fundamental embodiment of the invention, the semiconductor wafer 120 of the workpiece 100 manufactured by the WCSP technology easily can be ground to have its thickness less than 100 mm without having any scratches or cracks.

In the process of manufacturing the semiconductor device, after the workpiece 100 is ground, the grind tape 108 is removed. Then, a dicing tape is affixed to the workpiece 100, and then, the workpiece 100 is divided by a dicing blade into individual semiconductor devices.

According to the method of manufacturing the semiconductor device by using the fundamental embodiment of the invention, it is possible to obtain a relatively thin packaged semiconductor device having thickness less than a 1 mm. Under the most preferable dimensions used, a thin packaged semiconductor device having a 0.3 mm thickness can be obtained with the process of the fundamental embodiment.

Moreover, as described initially with respect to the fundamental embodiment, a semiconductor wafer, which is manufactured by a process of WCSP, is used as a representative example, and such a workpiece 100 is ground by a grinding machine 1. However, the invention is not limited to such a workpiece 100, and any kind of workpiece having no step differences at its periphery can be used for this invention. As explained below, the fundamental embodiment can be applied to another type of workpiece, with reference to FIGS. 6A and 6B.

Figure 6A:
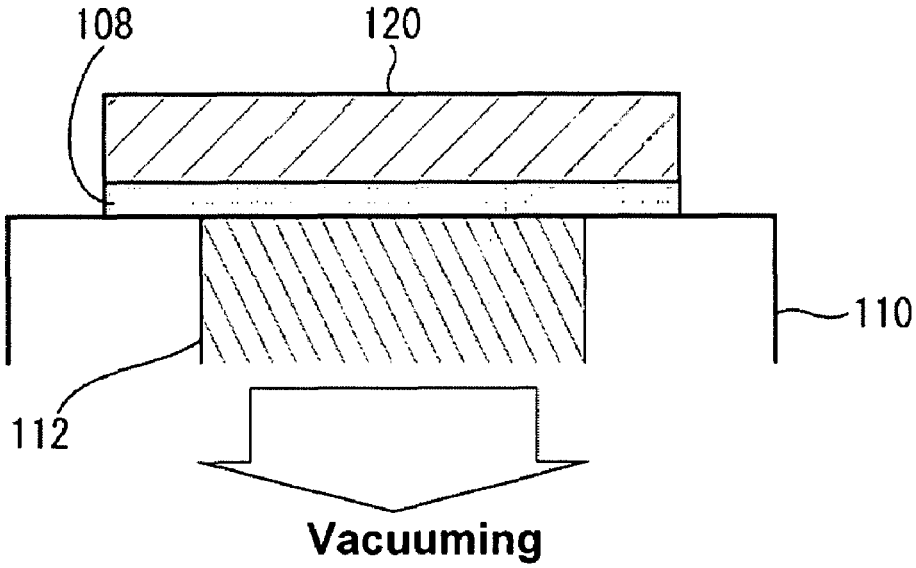
FIG. 6A is a sectional view showing a skeleton framework of another type of a workpiece used in the fundamental embodiment, and the chucking table on which the workpiece is mounted.
Figure 6B:
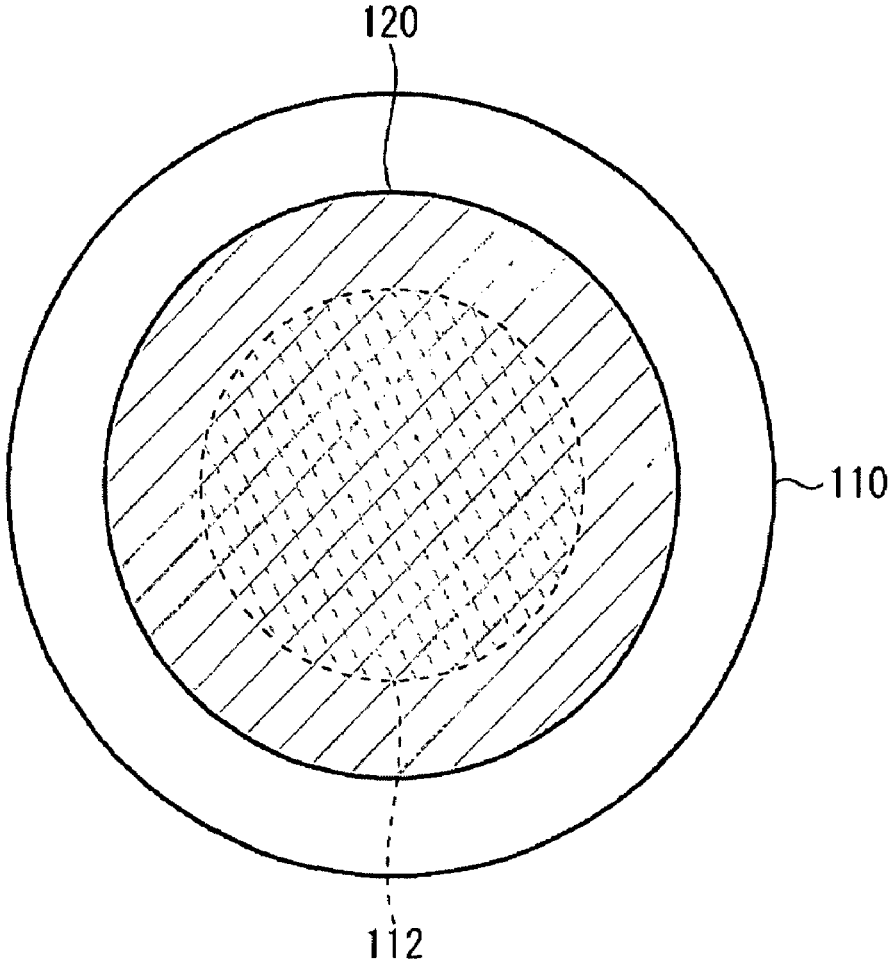
FIG. 6B is a plan view of FIG. 6A.

FIG. 6A is a sectional view showing a skeleton framework of another type of a workpiece 120 used in the fundamental embodiment and the chucking table 110 on which the workpiece 120 is mounted, and FIG. 6B is a plan view of FIG. 6A. As shown in FIGS. 6A and 6B, even if the workpiece 120 having no step differences is used, vibration may occur at the workpiece's edge.

As described above, the chucking area 112 of the chucking table 110 is smaller than the size of the workpiece 120. Thus, as shown in FIGS. 6A and 6B, the edge of the workpiece 120 is not affixed to the chucking table 110. Under this condition, when the grindstones pass on the edge of the workpiece 120 intermittently, vibration may occur at the area where the workpiece 120 is not affixed, that is, at the periphery. Thus, as described above, even when the workpiece 120 having no step difference is used for grinding, it is difficult to grind the workpiece 120 relatively thin, for example less than 100 μm.

However, the fundamental embodiment can also work well to another type of the workpiece 120. As described above, the grindstones continuously make contact with the workpiece 120 at its periphery. As a result, since the edge of the workpiece 100 is pressed against the chucking table 110 by the grindstone 14 continuously, vibration at the periphery of the workpiece 100 can be suppressed. As a result, it is possible to grind the workpiece 120 relatively thin such as less than 100 μm.

Modified Embodiments

Figure 7A:
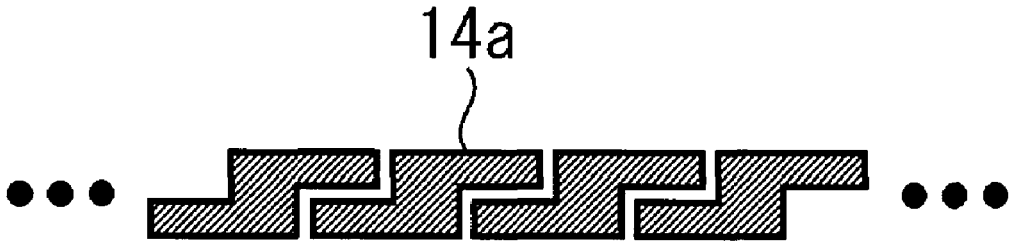
FIGS. 7A through 7C are plan views showing grindstones, according to a modified embodiment.
Figure 7B:
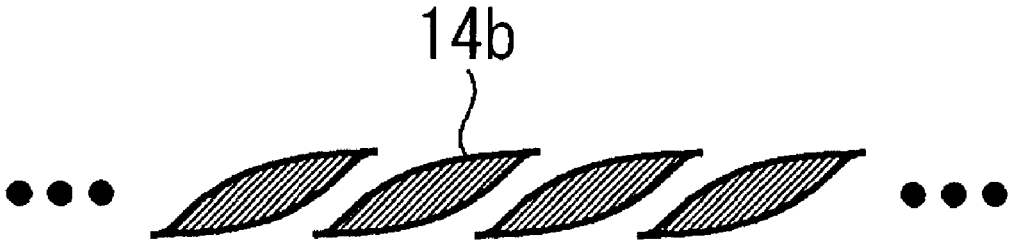
Figure 7C:
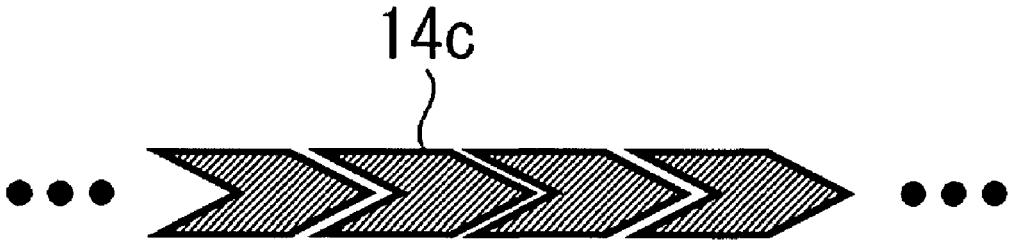

While the parallelogram-shaped grindstone 14 at its contacting surface is used in the fundamental embodiment, different-shaped grindstones 14*a*, 14*b* or 14*c* may be used as shown in FIGS. 7A through 7C. FIGS. 7A through 7C are plan views of the grindstones 14*a*, 14*b* or 14*c*, according to the modified embodiments. In each drawing, although the grindstones 14*a*, 14*b* or 14*c* are linearly-arranged for the sake of illustrative convenience, they are actually circularly arranged on the edge of the bottom surface of the spinning disk 12 as in FIG. 3B. In FIG. 7A, the contacting surface of each grindstone 14*a* is zigzag-shaped, and a plurality of the grindstones 14*a* having the same shape are regularly disposed. In FIG. 7B, the contacting surface of each grindstone 14*b* is leaf-shaped and a plurality of the grindstones 14*b* having the same shape are regularly disposed, and the contacting surface of each grindstone 14*c* is arrow-shaped in FIG. 7C, and a plurality of the grindstones 14*c* having the same shape are regularly disposed.

While the invention has been described with reference to illustrative embodiments, this description is not intended to be construed in a limiting sense. Thus, shapes, size and physical relationship of each component are roughly illustrated so the scope of the invention should not be construed to be limited to them. Further, to clarify the components of the invention, hatching is partially omitted in the cross-sectional views. Moreover, the numerical description in the embodiment described above is one of the preferred examples in the preferred embodiment so that the scope of the invention should not be construed to limit to them. For example, while a plurality of the grindstones is used in the fundamental and the modified embodiments, a single grindstone wheel having at least one slit can be used. In other words, the grindstone wheel having the slit is composed of an integrated combination of the grindstones. The grindstone wheel having the slit can be manufactured easily, that is, the slit or slits are formed with the dimensions described in the fundamental embodiment on the grindstone wheel. In the fundamental and the modified embodiments, although a plurality of the grindstone 14 should be fixed on the spinning disk 12, the single grindstone wheel having the slit facing the workpiece is simply fixed on the spinning disk.

Various other modifications of the illustrated embodiment will be apparent to those skilled in the art on reference to this description. Therefore, the appended claims are intended to cover any such modifications or embodiments as fall within the true scope of the invention.

What I claim is:

1. A method of manufacturing a semiconductor device, comprising:

(a) preparing a workpiece including a semiconductor wafer having a main surface on which semiconductor elements are formed, a protective layer formed on the main surface, and electrodes formed on the protective layer;

(b) providing a grind tape on an entire surface of the workpiece on which the electrodes are formed;

(c) preparing a grinding machine having a chucking table having a chucking area and a grinder head, the grinder head including, (i) a spinning disk rotating about a rotation axis, and (ii) a plurality of grindstones, which are circularly arranged on a surface of the spinning disk, whereby a slit is created between two adjacent grindstones, (d) affixing the workpiece in the chucking area of the chucking table, whereby a back surface of the workpiece is exposed;

(e) grinding the workpiece from the back surface thereof; and (f) dividing the ground workpiece into a plurality of individual devices, wherein the two adjacent grindstones include a first grindstone and a second grindstone and, while grinding the workpiece, the first grindstone comes in contact with an edge of the workpiece, and then the second grindstone comes in contact with the edge of the workpiece, and wherein the slit between the two adjacent grindstones is linear shaped and angled at an angle set to be between 30 and 60 degrees in a direction of rotation of the spinning disk from a line passing through the rotation axis and has a certain width, such that the second grindstone starts to come in contact with the edge of the workpiece before the first grindstone loses contact with the edge wherein the slit between the two adjacent grindstones is in such a shape that a line connecting a rotation axis of the spinning disk and the slit is unable to pass through the slit without contacting either the first grindstone or the second grindstone.

2. The method of claim 1, wherein while grinding the workpiece, the grinder head is rotated in one direction, and the chucking table is rotated in the opposite direction.

3. The method of claim 2, wherein the speed of the rotation of the grinder head is faster than that of the chucking table.

4. The method of claim 1, wherein the width of the slit is set to be between 1.0 mm and 2.5 mm.

5. The method of claim 1, wherein the slit is angled at an angle θ in the direction of rotation from a line passing through the rotation axis, the angle θ satisfying the following equation, $$\theta \le \tan^{-1}\left(\frac{d \times \tan x + p}{d}\right), \tan^{-1}\left(\frac{d \times \tan x - p}{d}\right) \le \theta$$

where "x" is an angle formed between a tangential line of the edge of the workpiece at a certain point and a straight line connecting the point to the rotation axis of the spinning disk wherein the point is a location where a grindstone outer locus and the edge of the workpiece are in contact, "d" is the width of the grindstone and "p" is the width of the slit.

6. The method of claim 1, wherein each grindstone is parallelogram-shaped at its contacting surface.

7. A method of manufacturing a semiconductor device, comprising:

(a) preparing a workpiece including a semiconductor wafer having a main surface on which semiconductor elements are formed, a protective layer formed on the main surface, and electrodes formed on the protective layer;

(b) providing a grind tape on an entire surface of the workpiece on which the electrodes are formed;

(c) preparing a grinding machine having a chucking table having a chucking area and a grinder head, the grinder head including, (i) a spinning disk rotating about a rotation axis, and (ii) a plurality of grindstones, which are circularly arranged on a surface of the spinning disk, whereby a slit is created between two adjacent grindstones, (d) affixing the workpiece in the chucking area of the chucking table, whereby a back surface of the workpiece is exposed;

(e) grinding the workpiece from the back surface thereof, in such a way that an edge of the ground back surface of the workpiece comes in contact with at least one of the grindstones at any time during the grinding; and (f) dividing the ground workpiece into a plurality of individual devices, wherein the two adjacent grindstones include a first grindstone and a second grindstone and, while grinding the workpiece, the first grindstone comes in contact with an edge of the workpiece, and then the second grindstone comes in contact with the edge of the workpiece, and wherein the slit between the two adjacent grindstones is linear shaped and angled at an angle set to be between 30 and 60 degrees in an opposite direction of rotation of the spinning disk from a line passing through the rotation axis and has a certain width, such that the second grindstone starts to come in contact with the edge of the workpiece before the first grindstone loses contact with the edge wherein the slit between the two adjacent grindstones is in such a shape that a line connecting a rotation axis of the spinning disk and the slit is unable to pass through the slit without contacting either the first grindstone or the second grindstone.

8. The method of claim 7, wherein the width of the slit is set to be between 1.0 mm and 2.5 mm.

9. The method of claim 7, wherein the slit is angled at an angle θ in the direction of rotation from a line passing through the rotation axis, the angle θ satisfying the following equation, $$\theta \leq \tan^{-1}\left(\frac{d \times \tan x + p}{d}\right), \tan^{-1}\left(\frac{d \times \tan x - p}{d}\right) \leq \theta$$

where "x" is an angle formed between a tangential line of the edge of the workpiece at a certain point and a straight line connecting the point to the rotation axis of the spinning disk wherein the point is a location where a grindstone outer locus and the edge of the workpiece are in contact, "d" is the width of the grindstone and "p" is the width of the slit.

10. A method of manufacturing a semiconductor device, comprising:

(a) preparing a workpiece including a semiconductor wafer having a main surface on which semiconductor elements are formed, a protective layer formed on the main surface, and electrodes formed on the protective layer;

(b) providing a grind tape on an entire surface of the workpiece on which the electrodes are formed;

(c) preparing a grinding machine having a chucking table having a chucking area and a grinder head, the grinder head including, (i) a spinning disk rotating about a rotation axis, and (ii) a plurality of grindstones, which are circularly arranged on a surface of the spinning disk, whereby a slit is created between two adjacent grindstones, (d) affixing the workpiece in the chucking area of the chucking table, whereby a back surface of the workpiece is exposed;

(e) grinding the workpiece from the back surface thereof, in such a way that an edge of the ground back surface of the workpiece comes in contact with at least one of the grindstones at any time during the grinding; and (f) dividing the ground workpiece into a plurality of individual devices, wherein the two adjacent grindstones include a first grindstone and a second grindstone and, while grinding the workpiece, the first grindstone comes in contact with an edge of the workpiece, and then the second grindstone comes in contact with the edge of the workpiece, and wherein the slit between the two adjacent grindstones is in such a shape that, while grinding the workpiece, the second grindstone starts to come in contact with the edge of the workpiece before the first grindstone loses contact with the edge wherein the slit between the two adjacent grindstones is in such a shape that a line connecting a rotation axis of the spinning disk and the slit is unable to pass through the slit without contacting either the first grindstone or the second grindstone.

11. The method of claim 10, wherein each grindstone is zigzag-shaped at its contacting surface.

12. The method of claim 10, wherein each grindstone is leaf-shaped at its contacting surface.

13. The method of claim 10, wherein each grindstone is arrow-shaped at its contacting surface.

* * * * *